US009353605B2

(12) United States Patent
Hailey, Jr. et al.

(10) Patent No.: US 9,353,605 B2
(45) Date of Patent: May 31, 2016

(54) FLOW DISTRIBUTION ASSEMBLIES FOR PREVENTING SAND SCREEN EROSION

(71) Applicant: Halliburton Energy Services, Inc., Houston, TX (US)

(72) Inventors: Travis Thomas Hailey, Jr., Sugar Land, TX (US); Stephen Michael Greci, Little Elm, TX (US); John Gano, Carrollton, TX (US); Weiqi Yin, Carrollton, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 0 days.

(21) Appl. No.: 14/406,062

(22) PCT Filed: Feb. 14, 2014

(86) PCT No.: PCT/US2014/016556

§ 371 (c)(1),
(2) Date: Dec. 5, 2014

(87) PCT Pub. No.: WO2015/122915

PCT Pub. Date: Aug. 20, 2015

(65) Prior Publication Data

US 2015/0322750 A1 Nov. 12, 2015

(51) Int. Cl.

| | |
|---|---|
| ***E21B 43/25*** | (2006.01) |
| ***E21B 43/08*** | (2006.01) |
| ***E21B 43/10*** | (2006.01) |
| ***E21B 43/12*** | (2006.01) |

(52) U.S. Cl.

CPC ..... *E21B 43/082* (2013.01); *E21B 43/08* (2013.01); *E21B 43/10* (2013.01); *E21B 43/12* (2013.01); *E21B 43/25* (2013.01)

(58) Field of Classification Search

CPC ..... E21B 43/08; E21B 43/10; E21B 43/12

See application file for complete search history.

(56) References Cited

U.S. PATENT DOCUMENTS

| | | | |
|---|---|---|---|
| 6,581,689 | B2 | 6/2003 | Hailey, Jr. |
| 7,708,068 | B2 | 5/2010 | Hailey, Jr. |
| 8,485,225 | B2 * | 7/2013 | Veit ..... E21B 34/102 137/624.27 |

(Continued)

FOREIGN PATENT DOCUMENTS

WO 2015122915 A1 8/2015

OTHER PUBLICATIONS

International Search Report and Written Opinion for PCT/US2014/016556 dated Nov. 13, 2014.

*Primary Examiner* — William P Neuder

(74) *Attorney, Agent, or Firm* — McDermott Will & Emery LLP

(57) ABSTRACT

Disclosed are flow distribution assemblies for distributing fluid flow through well screens. One flow distribution assembly includes a bulkhead arranged about a base pipe having one or more flow ports and defining flow conduits in fluid communication with the flow ports, a sand screen arranged about the base pipe and extending axially from the bulkhead, a flow annulus defined between the sand screen and the base pipe, and flow tubes fluidly coupled to the flow conduits and extending axially from the bulkhead within the flow annulus, the flow tubes being configured to place an interior of the base pipe in fluid communication with the flow annulus via the flow ports, wherein the flow tubes distribute a fluid through the at least one sand screen at a plurality of axial locations within the flow annulus.

24 Claims, 5 Drawing Sheets

(56) References Cited

U.S. PATENT DOCUMENTS

2007/0246407 A1 10/2007 Richards et al.
2008/0041588 A1* 2/2008 Richards ..... E21B 43/12 166/265
2008/0142227 A1 6/2008 Yeh et al.
2008/0289815 A1* 11/2008 Moen ..... E21B 43/086 166/230
2010/0108313 A1 5/2010 Chan et al.
2011/0162840 A1 7/2011 Haeberle et al.
2013/0092391 A1* 4/2013 Greene ..... E21B 43/12 166/369

* cited by examiner

FLOW DISTRIBUTION ASSEMBLIES FOR PREVENTING SAND SCREEN EROSION

BACKGROUND

The present disclosure generally relates to downhole fluid flow control and, more particularly, to flow distribution assemblies for use in distributing fluid flow through well screens.

In the course of completing wellbores that traverse hydrocarbon-bearing formations, it is oftentimes desirable to inject fluids into the wellbore for a number of purposes. For example, gases, such as steam, are often injected into surrounding formations in order to stimulate the production of high-viscosity hydrocarbons. In other applications, an acidizing treatment fluid, such as hydrochloric acid, is injected into the wellbore to react with acid-soluble materials disposed in the formation, thereby enlarging pore spaces in the formation. In yet other applications, fluids, such as water or gas, may be injected into the surrounding formations in order to maintain formation pressures so that a producing well can continue production. In applications, the pressure of the water or gas is injected at a rate sufficient to ensure fluid production out a well head.

Injection operations are typically carried out by introducing an injection string into the wellbore to a desired location where the fluid injection is desired. The injection string oftentimes includes a wellbore screen or "sand screen" arranged thereabout. Injection of the fluid occurs through the sand screen, which serves to prevent the influx of sand or particulates back into the injection string during temporary breaks in the injection operation. In some instances, the sand screen may form part of a "modular" screen assembly in which the outflow (injection), flows from a controlled outflow point into and through an annular space between the filter media and the base pipe of the modular screen before passing through the filter media, rather than flowing directly through holes in the base pipe of the sand screen.

Following an injection operation, the injection string can also be used as a type of production string by reversing the flow of fluids and instead drawing fluids into the injection string from the surrounding formations. During such production operations, the sand screens are again used to filter sand and any wellbore particulates of a certain size from being entrained into the injection tubing (i.e., the production tubing).

Injection and production operations are typically performed at high flow rates, which can lead to the erosion or degradation of vital portions of the sand screens. More particularly, some well screen assemblies include discrete entry/exit points to/from the injection tubing. The flow of fluids being either injected or produced is naturally concentrated at these locations. Over time, fluid flow through the sand screens at these locations can cut or erode through the sand screens, and thereby render the filtering capabilities of the sand screen ineffective.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid flow control and, more particularly, to flow distribution assemblies for use in distributing fluid flow through well screens.

The presently disclosed embodiments enable relatively high rates of fluid flow through modular sand screen assemblies during injection and/or production operations while generally preventing the erosion or damage of associated sand screens. This is accomplished by distributing the fluid flow through the sand screens both axially and angularly such that the fluids penetrate the sand screens more evenly over the axial length and circumference of the screens as opposed to passing through at fewer discrete entry/exit points. As a result, the maximum fluid flow velocity at any one point of the sand screens is reduced, thereby dramatically reducing potential erosion of the sand screens. As described in greater detail below, distributing the fluid flow over the length and circumference of the sand screens can be achieved using a system of tubes or "channels" installed within the annular space between the filter media of the sand screen and the base pipe of the sand screen. The tubes may be of different lengths and diameters to ensure that the fluid flow through the sand screens is evenly distributed so that the fluid flow is not focused at discrete locations.

Figure 1:
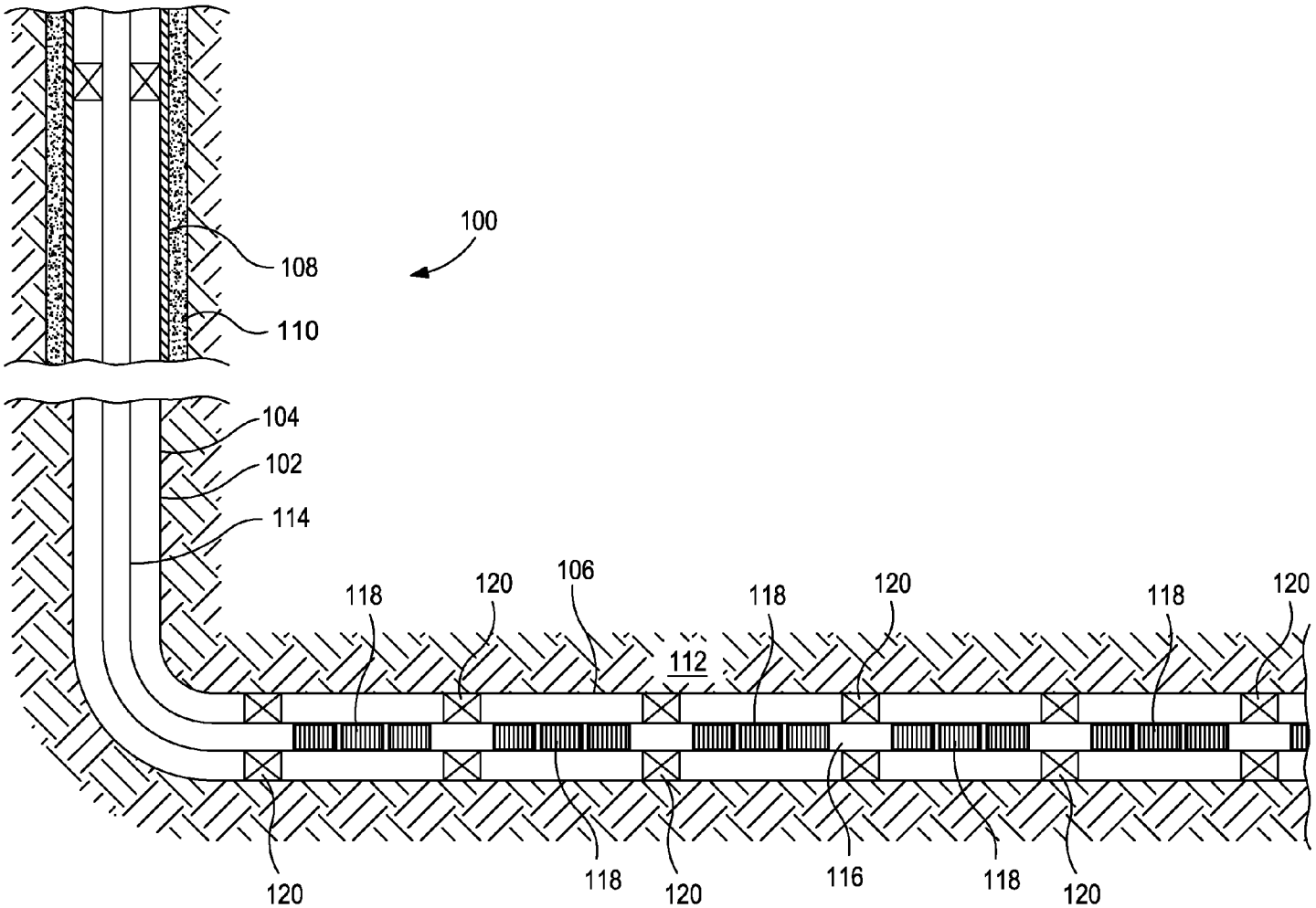
FIG. 1 illustrates an exemplary well system that can employ one or more principles of the present disclosure, according to one or more embodiments.

Referring to FIG. 1, illustrated is an exemplary well system 100 that can employ one or more principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a liner or casing string 108 secured therein with, for example, cement 110. The horizontal section 106 may extend through a hydrocarbon bearing subterranean formation 112. As illustrated, the horizontal section 106 may be arranged within or otherwise extend through an open hole section of the wellbore 102. In other embodiments, however, the horizontal section 106 of the wellbore 102 may be completed using casing 108 or the like, without departing from the scope of the disclosure.

A tubing string 114 may be positioned within the wellbore 102 and extend from the surface (not shown). The tubing string 114 provides a conduit for fluids to be conveyed either to or from the formation 112. Accordingly, the tubing string 114 may be characterized as an injection string in embodiments where fluids are introduced or otherwise conveyed into the formation 112, but may alternatively be characterized as production tubing in embodiments where fluids are extracted from the formation 112 to be conveyed to the surface.

At its lower end, the tubing string 114 may be coupled to a completion assembly 116 generally arranged within the horizontal section 106. The completion assembly 116 serves to divide the completion interval into various production intervals adjacent the formation 112. As depicted, the completion assembly 116 may include a plurality of flow distribution assemblies 118 axially offset from each other along portions of the completion assembly 116. Each flow distribution assembly 118 may include one or more sand screens positioned between a pair of wellbore isolation devices or packers 120. The packers 120 may be configured to provide a fluid seal between discrete portions of the completion assembly 116 and the wellbore 102, thereby defining corresponding production intervals.

In some embodiments, the flow distribution assemblies 118 may facilitate the injection of a fluid into the surrounding formation 112. In other embodiments, however, the flow distribution assemblies 118 may facilitate fluid production from the surrounding formation 112. The sand screens associated with each flow distribution assembly 118 may serve the primary function of filtering fluid streams such that particulates, sand, and/or other fines found within the wellbore 102 are prevented from entering the tubing string 114.

It should be noted that even though FIG. 1 depicts the flow distribution assemblies 118 as being arranged in an open hole portion of the wellbore 102, embodiments are contemplated herein where one or more of the flow distribution assemblies 118 is arranged within cased portions of the wellbore 102. Also, even though FIG. 1 depicts multiple flow distribution assemblies 118 with three sand screens disposed in each corresponding production interval, it will be appreciated that any number of flow distribution assemblies 118, each having any number of sand screens, may be deployed within a corresponding production interval, without departing from the principles of the present invention. In addition, even though FIG. 1 depicts multiple production intervals separated by the packers 120, it will be understood by those skilled in the art that the completion interval may include any number of production intervals with a corresponding number of packers 120 arranged therein. In other embodiments, the packers 120 may be entirely omitted from the completion interval, without departing from the scope of the disclosure.

Further, even though FIG. 1 depicts the flow distribution assemblies 118 as being arranged in the horizontal section 106 of the wellbore 102, those skilled in the art will readily recognize that the principles of the present disclosure are equally well suited for use in vertical wells, deviated wellbores, slanted wells, multilateral wells, combinations thereof, and the like. As used herein, directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
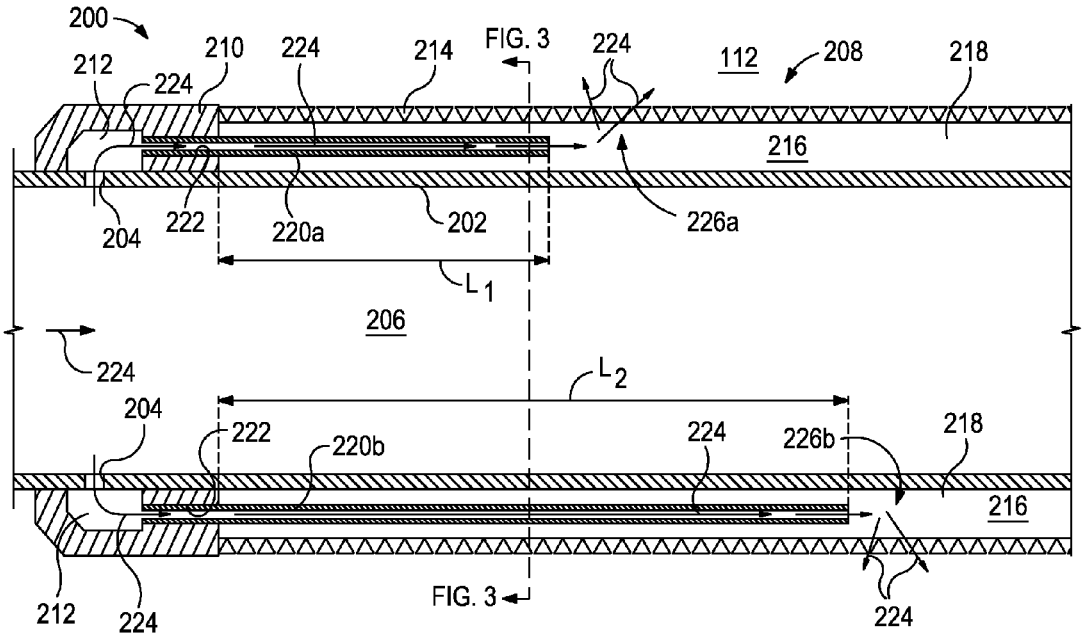
FIG. 2 illustrates a cross-section side view of an exemplary flow distribution assembly, according to one or more embodiments.

Referring now to FIG. 2, with continued reference to FIG. 1, illustrated is a cross-section side view of an exemplary flow distribution assembly 200, according to one or more embodiments. Along with the other exemplary flow distribution assemblies described herein below, the flow distribution assembly 200 (hereafter "assembly 200") may replace one or more of the flow distribution assemblies 118 described above with reference to FIG. 1, and may otherwise be used in the exemplary well system 100. As illustrated, the assembly 200 may include or otherwise be arranged about a base pipe 202, which may form part of the tubing string 114 of FIG. 1. The base pipe 202 may define one or more openings or flow ports 204 (two shown) configured to provide fluid communication between the interior 206 of the base pipe 202 and the surrounding subterranean formation 112. While only two flow ports 204 are depicted in FIG. 2, it will be appreciated that more than two flow ports 204 may be provided in the base pipe 202, without departing from the scope of the disclosure.

While not specifically depicted herein, those of skill in the art will readily appreciate that a sleeve (not shown) or other type of sliding side door may be arranged within the base pipe 202 and movable between open and closed positions. In the closed position, the sleeve may be configured to occlude the flow port(s) 204, and in the open position the sleeve is moved to expose the flow port(s) 204. The sleeve may be actuatable between the open and closed positions using any type of actuator such as, but not limited to, a mechanical actuator, an electric actuator, an electromechanical actuator, a hydraulic actuator, a pneumatic actuator, or any combination thereof. In other embodiments, the sleeve may be configured to move between closed and open positions by being acted upon by one or more wellbore projectiles, such as wellbore darts or balls. In yet other embodiments, the sleeve may be triggered to move between closed and open positions by assuming a pressure differential within the interior 206 of the base pipe 202.

The assembly 200 may further include a screen jacket 208 and a bulkhead 210, each being disposed about the exterior of the base pipe 202. The bulkhead 210 may be configured to provide a mechanical interface between the base pipe 202 and the screen jacket 208. In some embodiments, for example, the screen jacket 208 may be welded or brazed to the bulkhead 210. In other embodiments, the screen jacket 208 may be mechanically fastened to the bulkhead 210 using, for example, one or more mechanical fasteners (e.g., bolts, pins, rings, screws, etc.) or otherwise secured between the bulkhead 210 and a structural component of the bulkhead 210, such as a shroud or crimp ring. As illustrated, the screen jacket 208 may extend from the bulkhead 210 along the axial length of the base pipe 202.

The bulkhead 210 may be formed from a metal, such as 13 chrome, 304L stainless steel, 316L stainless steel, 420 stainless steel, 410 stainless steel, Incoloy 825, iron, brass, copper, bronze, tungsten, titanium, cobalt, nickel, combinations thereof, or the like. Moreover, the bulkhead 210 may be coupled or otherwise attached to the outer surface of base pipe 202 by being welded, brazed, threaded, mechanically fastened, shrink-fitted, or any combination thereof. In other embodiments, however, the bulkhead 210 may alternatively form an integral part of the screen jacket 208.

The bulkhead 210 may further define a flow chamber 212. In some embodiments, the flow chamber 212 may be configured to receive fluids from the interior 206 of the base pipe 202 to be injected into the surrounding formation 112. In other embodiments, however, the flow chamber 212 may be configured to receive fluids from the surrounding formation 112 to be conveyed into the base pipe 202 during production operations. While not shown, the bulkhead 210 may further include such structural components as shrouds or rings (e.g., a crimp ring or shrink ring) that help facilitate the construction of the assembly 200. In at least one embodiment, for instance, a shroud may be attached to the bulkhead 210 and substantially define the flow chamber 212, without departing from the scope of the disclosure.

The screen jacket 208 may include one or more well screens or sand screens 214, similar to the sand screens discussed above with reference to FIG. 1. More particularly, the sand screen(s) 214 may be characterized as a filter medium designed to allow fluids to flow therethrough (in either direction) but generally prevent the influx of particulate matter of a predetermined size. In some embodiments, the sand screens 214 may be fluid-porous, particulate restricting devices made from of a plurality of layers of a wire mesh that are diffusion bonded or sintered together to form a fluid porous wire mesh screen. In other embodiments, however, the sand screens 214 may have multiple layers of a weave mesh wire material having a uniform pore structure and a controlled pore size that is determined based upon the properties of the formation 112. For example, suitable weave mesh screens may include, but are not limited to, a plain Dutch weave, a twilled Dutch weave, a reverse Dutch weave, combinations thereof, or the like. In yet other embodiments, the sand screens 214 may include a single layer of wire mesh, multiple layers of wire mesh that are not bonded together, a single layer of wire wrap, multiple layers of wire wrap, or the like. Those skilled in the art will readily recognize that several other mesh or wire wrap designs are equally suitable, without departing from the scope of the disclosure.

Accordingly, the sand screens 214 may be wire wrap screens, swell screens, sintered metal mesh screens, expandable screens, pre-packed screens, treating screens, or any other type of sand control screen known to those of skill in the art. While not depicted in FIG. 2, in some embodiments, the screen jacket 208 may additionally include a drainage layer and/or an outer protective shroud. Moreover, in some embodiments, the sand screens 214 may have an additional mesh layer disposed about the outer perimeter thereof.

As illustrated, the screen jacket 208 may be radially offset from the base pipe 202, thereby defining a flow annulus 216 between the base pipe 202 and the sand screens 214. The radial offset between the base pipe 202 and the screen jacket 208 is caused by a plurality of ribs 218 that extend longitudinally from the bulkhead 210 and along the outer surface of the base pipe 202. As can be appreciated, the height or distance between the base pipe 202 and the sand screens 214 largely depends on the height of the ribs 218. While only two ribs 218 are depicted in FIG. 2, it will be appreciated that the assembly 200 may include several ribs 218 disposed about the circumference of the base pipe 202 and angularly spaced from each other.

In some embodiments, the ribs 218 have a generally triangular cross-section, where the base portion of the ribs 218 contact the base pipe 202 and exhibit an arcuate shape that substantially matches the curvature of base pipe 202. Alternatively, the base portion of the ribs 218 may be shaped such that the ribs 218 contact base pipe 202 only proximate the apex of the base portion of the ribs 218. In either case, once the assembly 200 is fully assembled, the base portion of the ribs 218 securely contact the base pipe 202 and may provide a fluid seal where the ribs 218 contact the base pipe 202.

Even though the ribs 218 have been described as having a generally triangular cross section, it should be understood by one skilled in the art that the ribs 218 may alternatively have other cross-sectional geometries including, but not limited to, rectangular and circular cross-sections. Additionally, it should be understood by one skilled in the art that the exact number of ribs 218 will be dependent upon factors such as the diameter of the base pipe 202, as well as other design characteristics that are well known in the art.

The assembly 200 may further include a plurality of channels or flow tubes 220, shown in FIG. 2 as a first flow tube 220*a* and a second flow tube 220*b*. The flow tubes 220*a,b* may extend axially from the bulkhead 210 along the exterior of the base pipe 202 and within the annulus 216. The flow tubes 220*a,b* may each be fluidly coupled to corresponding flow conduits 222 defined axially through the bulkhead 210, and thereby place the flow chamber 212 in fluid communication with the flow annulus 216. The flow tubes 220*a,b* may be fluidly coupled to the flow conduits 222 in a variety of ways including, but not limited to, welding, brazing, threading, mechanically fastening, shrink-fitting, or any combination thereof. In some embodiments, for instance, the flow tubes 220*a,b* may be extended at least partially into the flow conduits 222 in order to secure the flow tubes 220*a,b* to the bulkhead 210.

As indicated above, the assembly 200 may be configured to suitably operate in both injection and production operations. In the following description, exemplary operation of the assembly 200 is provided with respect to an injection operation. However, those skilled in the art will readily appreciate that the advantages gained by using the assembly 200 for injection operations are equally applicable to using the assembly 200 in production operations, without departing from the scope of the disclosure.

In exemplary operation, a fluid 224 may be conveyed or pumped to the location of the assembly 200 within the interior 206 of the base pipe 202. In the present embodiment, the fluid 224 may be any fluid used for a wellbore injection operation including, but not limited to, water (e.g., fresh water, saltwater, brine, etc.), gases (e.g., natural gas, $CO_2$, air, steam, etc.), and/or acids (or other wellbore treatment fluids). Upon encountering the assembly 200, the fluid 224 may be able to enter the flow chamber 212 via the flow ports 204 and subsequently flow into the flow tubes 220*a,b* secured to the bulkhead 210. The flow tubes 220*a,b* may then eject the fluid 224 into the flow annulus 216 where the fluid 224 is then able to penetrate the screen jacket 208 at various axial and angular locations of the sand screen 214 and subsequently enter the surrounding formation 112. In some embodiments, injection of the fluid 224 into the formation 112 may be undertaken in an effort to maintain formation pressures so that a producing well can efficiently continue production. As will be appreciated, the fluid pressures required in any of the injection operations described herein are not limited to a particular threshold, but may instead be at any pressure that enables the particular application.

According to the present disclosure, the assembly 200 may be configured to distribute the flow of the fluid 224 through the screen jacket 208 such that the fluid 224 penetrates the sand screens 214 over a plurality of axial and angular locations along the exterior of the base pipe 202. As will be appreciated, this may prove advantageous in preventing the fluid 224 from penetrating the screen jacket 208 at fewer discrete exit points with higher velocity and where the fluid 224 could potentially erode the sand screens 214 and thereby frustrate their filtering capability.

In order to ensure that the fluid 224 penetrates the sand screens 214 over a plurality of axial and angular locations along the exterior of the base pipe 202, the flow tubes 220*a,b* may exhibit varying or different axial lengths. In the illustrated embodiment, for example, the first flow tube 220*a* exhibits a first axial length $L_1$ and the second flow tube 220*b* exhibits a second axial length $L_2$ that is longer than the first axial length $L_1$. As a result, the fluid 224 exiting the first flow tube 220*a* will generally penetrate the sand screens 214 at a first axial location 226*a*, while the fluid 224 exiting the second flow tube 220*b* will generally penetrate the sand screens 214 at a second axial location 226*b* further from the bulkhead 210 than the first axial location 226*a*. Accordingly, the fluid 224 exiting the first and second flow tubes 220*a,b* is not concentrated at a single axial location within the flow annulus 216, but is instead able to penetrate the sand screens 214 at varying axial locations (i.e., at least the first and second axial locations 226*a,b*).

Figure 3:
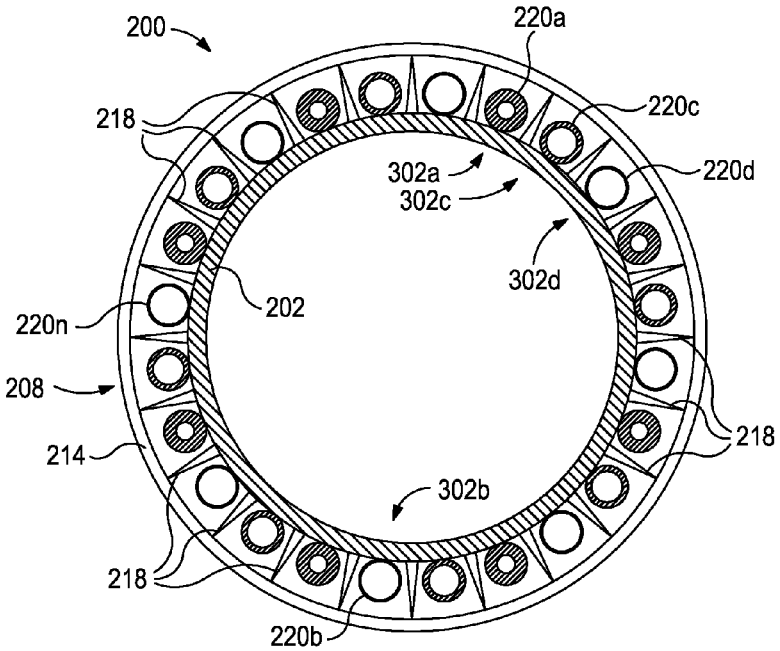
FIG. 3 illustrates an axial end view of the assembly of FIG. 2 as taken along the lines shown in FIG. 2.

Referring now to FIG. 3, with continued reference to FIG. 2, illustrated is an axial end view of the assembly 200 as taken along the lines shown in FIG. 2. As depicted in FIG. 3, besides the first and second flow tubes 220*a,b*, the assembly 200 may include several additional flow tubes 220 (shown as additional flow tubes 220*c*, 220*d*, . . . , 220*n*) arranged about the circumference of the base pipe 202. While a particular number of flow tubes 220*a-n* is depicted in FIG. 3, it will be appreciated that any number of flow tubes 220*a-n* may be used, depending primarily on the dimensions of the base pipe 202 and the size of the flow tubes 220*a-n*, without departing from the scope of the disclosure. As illustrated, each flow tube 220*a-n* interposes an adjacent pair of ribs 218, where the ribs 218 help radially support the screen jacket 208 and associated sand screens 214 in order to define the flow annulus 216 (FIG. 2), as generally described above. In other embodiments, more than one flow tube 220*a-n* may interpose an adjacent pair of ribs 218, without departing from the scope of the disclosure.

As indicated above, the flow tubes 220*a-n* may exhibit a different axial length, thereby allowing the assembly 200 to provide the fluid 224 (FIG. 2) into the flow annulus 216 at a number of axial locations corresponding to the number of flow tubes 220*a-n*. In some embodiments, for instance, a first set of the flow tubes 220*a-n* may exhibit a first axial length (e.g., the first axial length $L_1$ of FIG. 2), a second set of the flow tubes 220*a-n* may exhibit a second axial length (e.g., the second axial length $L_2$ of FIG. 2), and a third set of the flow tubes 220*a-n* may exhibit a third axial length, where the first, second, and third axial lengths are different from each other. Accordingly, in such embodiments, the assembly 200 may be configured to provide the fluid 224 (FIG. 2) into the flow annulus 216 at different first, second, and third axial locations corresponding to the axial lengths of the first, second, and third sets of flow tubes 220*a-n*, respectively.

As will be appreciated, sets of flow tubes 220*a-n* may alternatively exhibit more than three axial lengths, without departing from the scope of the disclosure, and thereby provide fluid 224 into the flow annulus 216 at even more axial locations. Consequently, it will be appreciated that any variation in axial lengths and groupings (i.e., sets) of the flow tubes 220*a-n* are contemplated herein as being within the scope of the disclosure in order to provide the fluid 224 into the flow annulus 216 at a variety of axial locations. As a result, the maximum flow velocity of the fluid 224 penetrating the sand screen 214 at any one point of the sand screens 214 may be reduced, thereby dramatically reducing the potential for erosion of the sand screens 214.

Moreover, since the flow tubes 220*a-n* are independently arranged about the circumference of the base pipe 202, the assembly 200 may further be configured to provide the fluid 224 into the flow annulus 216 at a variety of angular locations about the base pipe 202. For instance, the first and second flow tubes 220*a* and 220*b* may be configured to provide the fluid 224 into the flow annulus 216 at corresponding first and second angular locations 302*a* and 302*b*, respectively, where the first and second angular locations 302*a,b* are about 180° offset from each other. Similarly, the third and fourth flow tubes 220*c* and 220*d* may each be configured to provide the fluid 224 into the flow annulus 216 at corresponding third and fourth angular locations 302*c* and 302*d*, respectively, where all the angular locations 302*a-d* are angularly offset from each other by varying angular distances. As a result, the fluid 224 can be injected into the annulus 216 at a variety of angular locations so that it penetrates the sand screens 214 at the variety of angular locations and otherwise not at a single angular location which could lead to erosion of the sand screen 214. Consequently, it will be appreciated that any variation in angular orientation of the flow tubes 220*a-n* are also contemplated herein as being within the scope of the disclosure in order to provide the fluid 224 into the flow annulus 216 at a variety of angular locations.

In the illustrated embodiment of FIG. 3, the flow tubes 220*a-n* are depicted as having a generally cylindrical or circular cross-sectional shape. In other embodiments, however, one or more of the flow tubes 220*a-n* may have a polygonal cross-section, such as triangular, rectangular, square, trapezoidal, or any other polygonal shape. In yet other embodiments, one or more of the flow tubes 220*a-n* may exhibit a cross-sectional shape that is substantially oval, ovoid, or kidney shaped. As will be appreciated, different cross-sectional shapes may be employed in order to more efficiently use the space provided by the flow annulus 216 between the ribs 218, and thereby increase the flow capacity of the assembly 200.

Still referring to FIGS. 2 and 3, the flow tubes 220*a-n* may exhibit or otherwise provide varying inner diameters, wall thicknesses, or inner flow areas with respect to each other. In the illustrated embodiment, for example, the first flow tube 220*a* exhibits an inner diameter that is smaller than the inner diameter of the second flow tube 220*b*. Moreover, the third flow tube 220*c* exhibits an inner diameter that is smaller than the second flow tube 220*b* but larger than the first flow tube 220*a*. Those skilled in the art will readily appreciate that having varying inner diameters in the flow tubes 220*a-n* may further help distribute the flow of the fluid 224 more evenly along the sand screens 214. For instance, shorter flow tubes 220*a-n* may be configured to exhibit smaller inner diameters than the longer flow tubes 220*a-n*. Without this variance in inner diameters, the flow of the fluid 224 would tend to flow at a higher rate through shorter flow tubes, such as the first flow tube 220*a*, than through longer flow tubes, such as flow tubes 220*b* and/or 220*c*, according to the greater friction pressure loss in the longer tube 220*b,c*. A variance in inner diameters is one means to compensate for this difference pressure losses over the length of the flow tubes 220*a-n* so that the flow rate is more equal in each tube for a given overall flow rate.

In some embodiments, a particular inner diameter (or inner flow area) for any given flow tube 220*a-n* may be achieved by having a uniform inner diameter dimension along the entire axial length of the given flow tube 220*a-n*. In other embodiments, as discussed in more detail below, a particular inner diameter for any given flow tube 220*a-n* may equally be achieved by inserting a nozzle or other type of flow restrictor of a desired diameter into the flow tube 220*a-n* and thereby restricting the amount of fluid 224 that is able to traverse the flow tube 220*a-n*. A well operator may be able to selectively design flow tubes 220*a-n* of varying inner diameters (or with varying nozzles inserted) in order to optimally balance the flow of the fluid 224 into the flow annulus 216 for a given flow rate, and thereby maximize injection rates. More specifically, with flow tubes 220*a-n* of known inner diameters and lengths, the well operator may be able to determine the flow rate capabilities of the assembly 200. In some embodiments, for example, an optimally balanced flow would be designed for the maximum injection rate (or production rate for production operations) that is anticipated for a given well completion.

In some embodiments, the flow tubes 220*a-n* may be configured to be erosion resistant or otherwise made of an erosion resistant material. For instance, the flow tubes 220*a-n* may be made of erosion resistant materials including, but not limited to, carbides (e.g., tungsten, titanium, tantalum, and vanadium embedded in a matrix of cobalt or nickel by sintering) and ceramics. In other embodiments, the flow tubes 220*a-n* may be made of a metal or other material that is internally cladded or coated with an erosion-resistant material such as, but not limited to, tungsten carbide or ceramic. In yet other embodiments, the flow tubes 220*a-n* may be made of a material that has been surface hardened, such as surface hardened metals (e.g., via nitriding), heat treated metals (e.g., using 13 chrome), carburized metals, or the like.

In other embodiments, one or more of the flow tubes 220*a-n* may be omitted from the assembly 200 and in its place, a makeshift or simulated flow tube may instead be generated or created by a well operator. In applications where the sand screen 214 is a wire wrap screen, for example, the sand screen 214 is formed by wrapping wire around the ribs 218 a plurality of turns. A void or flow gap results between each turn through which fluids may penetrate the sand screen 214. The simulated flow tubes may be created by sealing such flow gaps longitudinally between a pair of circumferentially adjacent ribs 218. The flow gaps may be sealed with a filler material, for example, such as an epoxy resin or the like. The filler material may be selectively placed in the gaps between the turns of the screen wire such that a fluid sealed conduit or passageway is created between the given pair of circumferentially adjacent ribs 218. Generating such simulated flow tubes is described in more detail in co-owned U.S. Pat. No. 6,581,689.

As will be appreciated, the length of the resulting fluid sealed conduit or passageway may be determined by depositing the filler material along a greater or lesser length of the assembly 200. At the end of the sealed length, the fluid 224 may then be able to penetrate the sand screen 214 during operation. As will be appreciated, such embodiments may prove advantageous in generating flow channels that have a greater flow capacity than would otherwise be possible with the flow tubes 220*a-n*. More particularly, by omitting a flow tube 220*a-n*, the flow area that would otherwise have been taken up by the physical structure of the flow tube 220*a-n* may then be utilized as a part of the flow conduit.

Figure 4:
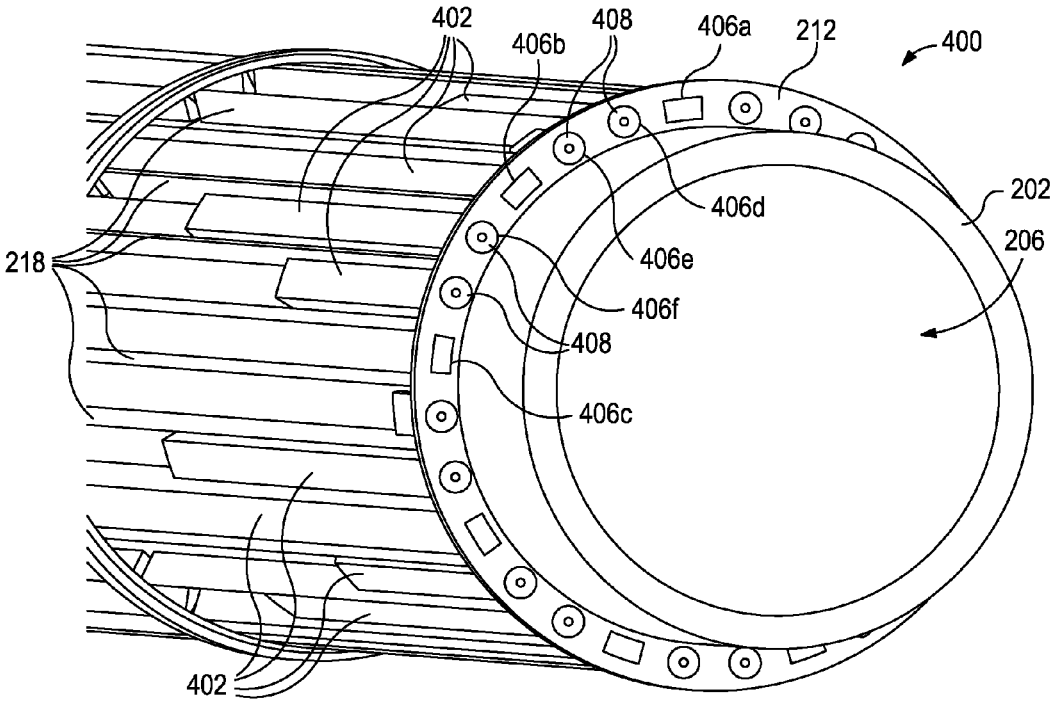
FIG. 4 illustrates an isometric end view of another exemplary flow distribution assembly, according to one or more embodiments.

Referring now to FIG. 4, with continued reference to FIGS. 2 and 3, illustrated is an isometric end view of another exemplary flow distribution assembly 400, according to one or more embodiments. The flow distribution assembly 400 (hereafter "assembly 400") may be similar in some respects to the assembly 200 of FIGS. 2 and 3 and therefore will be best understood with reference thereto, where like numerals represent like elements not described again in detail. In the illustrated embodiment, the screen jacket 208 and associated sand screens 214 (FIGS. 2 and 3) have been removed in order to expose a plurality of flow tubes 402 that interpose adjacent pairs of ribs 218.

The flow tubes 402 may be similar to the flow tubes 220*a-n* of FIGS. 2 and 3. More particularly, the flow tubes 402 may be configured to provide a fluid to the flow annulus 216 (FIGS. 2 and 3) at a plurality of axial and angular locations along the exterior of the base pipe 202 such that the flow of the fluid penetrating the sand screens 214 (FIGS. 2 and 3) may be more evenly distributed. To accomplish this, as illustrated, the flow tubes 402 may exhibit varying axial lengths about the circumference of the base pipe 202.

In the illustrated embodiment of FIG. 4, portions of the bulkhead 210 have also been removed in order to provide an axial end view of the flow tubes 402 being fluidly coupled to the bulkhead 210. As illustrated, the flow tubes 402 may generally exhibit a rectangular cross-sectional shape. Some of the longer flow tubes 402 may be directly coupled to the bulkhead, such as at points 406*a*, 406*b*, and 406*c*, where a rectangular shape is formed in the bulkhead 210. With some of the shorter flow tubes 402, however, a nozzle 408 or other type of flow restrictor may be placed in the inlet to such flow tubes 402, such as at points 406*d*, 406*e*, and 406*f*. As generally described above, the nozzles 408 may be configured to restrict the amount of fluid that is able to traverse the given flow tube 402 and thereby optimally balance the flow of the fluid into the flow annulus and thereby maximize injection rates.

In some embodiments, the nozzle 408 may exhibit the same cross-sectional shape as the flow tubes 402. In other embodiments, such as is shown in FIG. 4, the nozzle 408 may exhibit a different cross-sectional shape (i.e., circular) than the tubes 402 (i.e., rectangular or polygonal). In such embodiments, a transition connector (not shown) may be used to fluidly couple the differing cross-sectional shapes, wherein one end of the transition connector may exhibit the cross-sectional shape of the tube 402 and the opposing end of the transition connector may exhibit the cross-sectional shape of the nozzle 408. Moreover, the nozzles 408 may be made of an erosion resistant material such as, but not limited to, tungsten carbide (or any carbide) and a ceramic.

In some embodiments, and in order to distribute flow more evenly across multiple screen jackets or multiple sections of screens, one or more of the flow tubes 402 may extend axially to another axially-offset or adjacent flow distribution assembly (not shown) or otherwise across one or more screen joints. Accordingly, such flow tubes 402 may be configured to convey the fluid 224 (FIG. 2) to adjoining sand screen sections (not shown) where they may fluidly connect to other flow tubes that may be configured to eject the fluid in an axially adjacent flow annulus. Any such flow tubes 402 that may convey the fluid 224 to an adjoining sand screen section or sections may connect the flow to a bulkhead area similar to the bulkhead area 212 shown in FIG. 2, and the flow thus conveyed may be distributed to exit through a system of tubes or channels in the adjoining sand screen section or sections that is similar to the systems already described in FIG. 2, 3, or 4. Alternatively, the flow conveyed to an adjoining sand screen section or sections may not require a specialized flow distribution system such as that described in FIG. 2, 3, or 4, as the flow rate entering the adjoining sand screen section or sections will be less, according to the amount of flow that has penetrated the filter media of the initial sand screen section, and so a conventional sand screen section or sections may tolerate the uncontrolled flow penetration at the reduced flow rate without risk of erosion.

Figure 5:
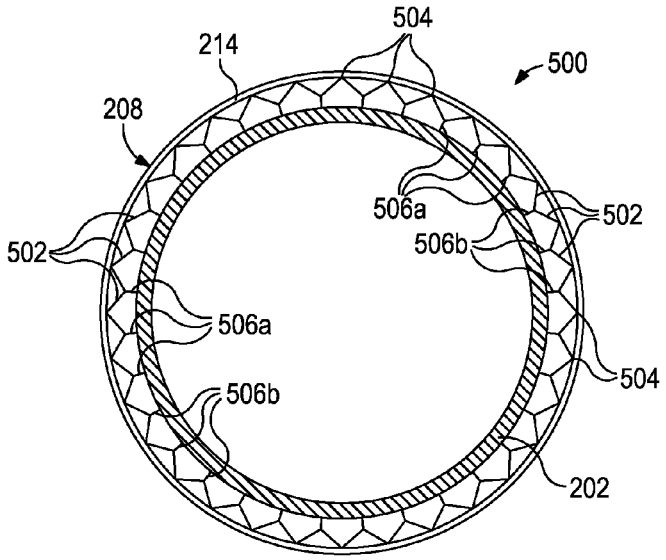
FIG. 5 illustrates a cross-sectional end view of another exemplary flow distribution assembly, according to one or more embodiments.

Referring now to FIG. 5, with continued reference to the prior figures, illustrated is a cross-sectional end view of another exemplary flow distribution assembly 500, according to one or more embodiments. The flow distribution assembly 500 (hereafter "assembly 500") may be similar in some respects to the assembly 200 of FIGS. 2 and 3 and therefore will be best understood with reference thereto, where like numerals represent like elements not described again.

As illustrated, the screen jacket 208, including the associated sand screens 214, may be arranged about the base pipe 202. In the illustrated embodiment, however, the ribs 218 (FIGS. 2 and 3) that would normally support the sand screen 214 may be omitted. The screen jacket 208 may instead be supported by a plurality of flow tubes 502. Accordingly, in the illustrated embodiment, the flow tubes 502 may be configured to serve as fluid conduits, as generally described herein, but also as ribs that support the sand screen 214. As will be appreciated, removing the ribs 218 in the assembly 500 may prove advantageous in freeing up potential flow area that can now be fully used by the flow tubes 502. As a result, an increased amount of the fluid 224 (FIG. 2) may be conveyed into the flow annulus 216 (FIG. 2) and subsequently into the surrounding formation 112 (FIGS. 2 and 3).

As illustrated, the flow tubes 502 may generally exhibit a pentagonal cross-sectional shape that provides an apex 504 and first and second legs 506*a* and 506*b* that extend toward the base pipe 202. In some embodiments, the pentagonal flow tubes 502 include a base portion (not shown) coupled to the legs 506*a,b* that contacts the base pipe 202. In other embodiments, however, the base portion is omitted and the legs 506*a,b* may instead be configured to engage the outer surface of the base pipe 202. As will be appreciated, omitting the base portion of the pentagonal shape may allow for greater potential flow area for the flow tubes 502.

During manufacturing of the assembly 500, the wires of the sand screen 214 are wrapped around the base pipe 202 and contact the apex 504 of each flow tube 502. As the wires are tightly secured against the apices 504, the legs 506*a* and 506*b* of each flow tube 502 are forced into radial engagement with the outer surface of the base pipe 202. Forcing the legs 506*a,b* into engagement with the base pipe 202 may result in the formation of a metal-to-metal seal at each leg 506*a,b*. In some embodiments, the legs 506*a,b* may be sharpened or otherwise configured to dig into the base pipe 202 in order to ensure a sealed conduit. Moreover, as the wires of the sand screen 214 are tightened, the legs 506*a,b* of adjacent tubes 502 may be forced into contact with each other and thereby provide an added amount of structural integrity to the assembly 500. The number and size of the flow tubes 502 can be adjusted based on the amount of flow area required for fluid passage. Moreover, the height of the flow tubes 502 can be taller than standard wire wrap ribs due to the large base that provides stability during wrapping.

In some embodiments, the flow tubes 502 may be directly coupled to the bulkhead 210 (FIG. 2) such that the flow conduits 222 (FIG. 2) defined axially through the bulkhead 210 may exhibit a similar pentagonal cross-sectional shape. In other embodiments, however, the assembly 500 may further include one or more transition connectors (not shown), as described above, configured to fluidly couple the differing cross-sectional shapes of the flow tubes 502 and the flow conduits 222, without departing from the scope of the disclosure.

As with the flow tubes 220*a-n* of FIGS. 2 and 3, the flow tubes 502 may exhibit differing axial lengths and groupings (i.e., sets) in order to provide the fluid 224 (FIG. 2) into the flow annulus 216 (FIG. 2) at all desired axial and angular locations and thereby distribute the flow more evenly along the axial length of the assembly 500. In some embodiments, where each flow tube 502 ends, a rib (not shown) may extend the rest of the way to the next screen joint in order to provide a continuous support for the sand screen 214 to wrap around the base pipe 202. In other embodiments, however, several of the flow tubes 502 may extend the entire length between screen joints in order to provide locations for the sand screen 214 to wrap around the base pipe 202.

Figure 6A:
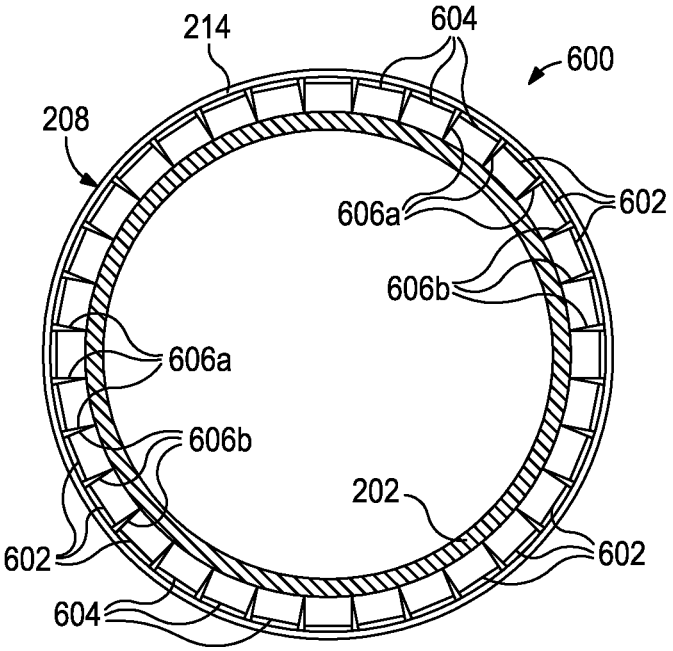
FIG. 6A illustrates a cross-sectional end view of another exemplary flow distribution assembly, according to one or more embodiments.
Figure 6B:
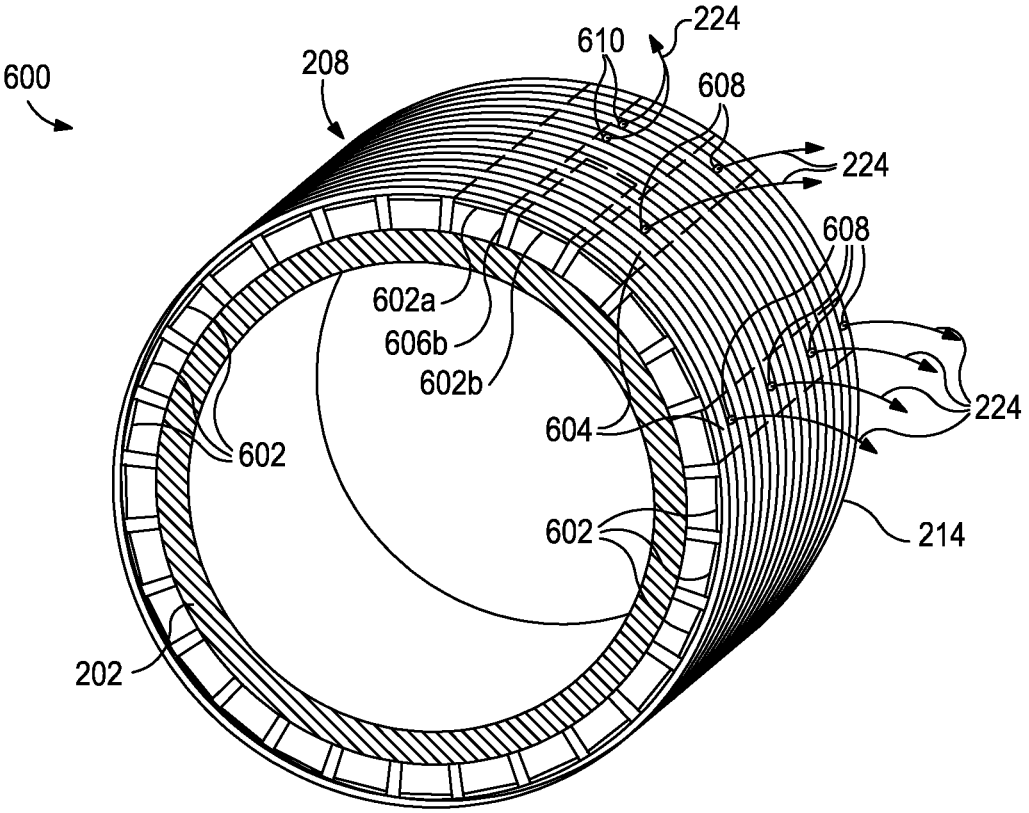
FIG. 6B illustrates an isometric view of a portion of the flow distribution assembly of FIG. 6A.

Referring now to FIGS. 6A and 6B, with continued reference to FIG. 5 and the prior figures, illustrated are cross-sectional end and isometric views, respectively, of another exemplary flow distribution assembly 600, according to one or more embodiments. The flow distribution assembly 600 (hereafter "assembly 600") may be similar in some respects to the assembly 200 of FIGS. 2 and 3 and the assembly 500 of FIG. 5, and therefore will be best understood with reference thereto, where like numerals represent like elements not described again.

As illustrated, the screen jacket 208, including the associated sand screens 214, may be arranged about the base pipe 202. Similar to the assembly 500, the ribs 218 (FIGS. 2 and 3) may again be omitted in the assembly 600. The screen jacket 208 may instead be configured to seat against a plurality of flow tubes 602. As with the assembly 500, the flow tubes 602 may serve dual purposes as both fluid conduits for conveying the fluid into the flow annulus 216 (FIG. 2) and as ribs that structurally support the sand screen 214.

The flow tubes 602 may generally exhibit an "H" cross-sectional shape having a crossbar 604 and a pair of legs 606*a* and 606*b* that extend between the sand screens 214 and the base pipe 202. During manufacturing of the assembly 600, the wires of the sand screen 214 are wrapped around the base pipe 202 and place compressive stress on the legs 606*a,b* of each flow tube 602. As the wires are tightly secured, the legs 606*a,b* of each flow tube 602 are forced into radial engagement with the outer surface of the base pipe 202. In some embodiments, a metal-to-metal seal results between each leg 606*a,b* and the outer surface of the base pipe 202. The number and size of the flow tubes 602 can be adjusted based on the amount of flow area required for fluid passage. Moreover, the height of each flow tube 602 can be taller than standard wire wrap ribs due to the large base that provides stability during wrapping.

As with the flow tubes 220*a-n* of FIGS. 2 and 3 and the flow tubes 502 of FIG. 5, the flow tubes 602 may exhibit differing axial lengths and groupings (i.e., sets) in order to provide the fluid 224 (FIG. 2) into the flow annulus 216 (FIG. 2) at all desired axial and angular locations and thereby distribute the flow more evenly along the assembly 600. Moreover, in some embodiments, where each flow tube 602 ends, a rib (not shown) may extend the rest of the way to the end of the screen section in order to provide a continuous axial support for the sand screen 214 to wrap around the base pipe 202. Alternatively, the crossbar 604 of an H-shaped flow tube 602 may be at least partially milled away in order to create a flow exit point of the tube 602 at any desired axial location, and the legs 606*a* and 606*b* may continue to the end of the screen section in order to provide a continuous support for the sand screen 214 to wrap around the base pipe 202. In yet other embodiments, however, several intact flow tubes 602 may extend the entire length between screen joints in order to provide locations for the sand screen to wrap around the base pipe 202.

Referring specifically to FIG. 6B, in some embodiments, one or more radial perforations 608 may be defined in the crossbar 604 of at least one of the flow tubes 602. In the illustrated embodiment, as shown in dashes extending beneath the sand screen 214, multiple radial perforations 608 are defined in the corresponding crossbars 604 of two of the flow tubes 602. Each radial perforation 608 may allow a portion of the fluid 224 to exit the corresponding flow tubes 602 and traverse the sand screen 214 at various axial locations. As will be appreciated, the radial perforations 608 may prove advantageous in allowing the flow energy of the fluid 224 to gradually dissipate along the axial length of the flow tubes 602, instead of assuming the full force of the flow energy exiting the given flow tube 602 at the end thereof.

The number of radial perforations 608 defined in any given flow tube 602 may vary, depending on the application and known flow constraints. The size of the radial perforations 608 may also vary. For instance, in some embodiments it may be desirable to have larger radial perforations 608 at or near the distal end of the corresponding flow tube 602, which allow a higher volumetric flow rate of the fluid 224. At the distal end of the flow tube 602, the flow energy of the fluid 224 is more likely to be dissipated and, therefore, less likely to erode the sand screen 214 upon being ejected from the radial perforations 608 at high volumetric flow rates.

In at least one embodiment, the radial perforations 608 may be equidistantly spaced along the axial length of the corresponding flow tube 602. In other embodiments, the spacing of the radial perforations 608 may vary or otherwise not be uniform. For instance, it may be desirable to have the density or frequency of radial perforations 608 gradually increase along the axial length of the corresponding flow tube 602, and thereby allow the flow energy to dissipate gradually and increasingly in the axial direction. In other embodiments, a series of radial perforations 608 may be defined in a given flow tube 602 along a first section of the flow tube 602, and then followed by a second section of the flow tube 602 where radial perforations 608 are provided. A third section of the flow tube 602 may follow the second section and provide another series of radial perforations 608. As can be appreciated, this pattern may be repeated, or other patterns utilizing the radial perforations 608 may be utilized, without departing from the scope of the disclosure.

Still referring to FIG. 6B, in some embodiments, one or more circumferential perforations 610 may be defined in one or more of the legs 606*a,b* of a given flow tube 602. While depicted in FIG. 6B as circular, the shape or configuration of the circumferential perforations 610 may encompass any type or shape of opening in the legs 606*a,b* of the flow tubes 602. For instance, the circumferential perforations 610 may be, but are not limited to, cuts, slots, holes, notches, or any combination thereof defined in the legs 606*a,b* of the flow tubes 602.

In the illustrated embodiment, two circumferential perforations 610 are depicted as being defined in the second leg 606*b* of a first flow tube 602*a*. A second flow tube 602*b* terminates a short distance as extended into the flow annulus 216 (FIG. 2) beneath the sand screens 214, and thereby exposing the circumferential perforations 610 to the sand screens 214. Similar to the radial perforations 608, the circumferential perforations 610 may allow a portion of the fluid 224 to exit the corresponding flow tubes 602 and traverse the sand screen 214 at various axial locations. Accordingly, the circumferential perforations 610 may also help to gradually dissipate the flow energy of the fluid 224 along the axial length of the flow tubes 602 instead of having the full force of the flow energy exiting the given flow tube 602 assumed at the end thereof. Moreover, similar to the radial perforations 608, the number, density, and size of the circumferential perforations 610 defined in any given flow tube 602 may vary, depending on the application and flow constraints.

Figure 7:
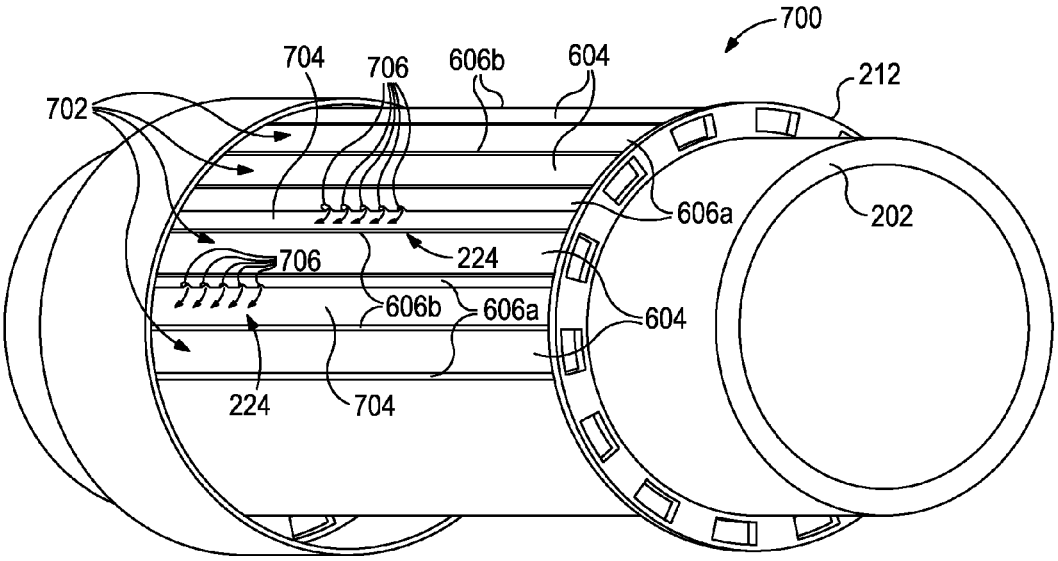
FIG. 7 illustrates an isometric end view of another exemplary flow distribution assembly, according to one or more embodiments.

Referring now to FIG. 7, with continued reference to the prior figures, illustrated is an isometric end view of another exemplary flow distribution assembly 700, according to one or more embodiments. The flow distribution assembly 700 (hereafter "assembly 700") may be similar in some respects to the assembly 200 of FIGS. 2 and 3 or the assembly 400 of FIG. 4, and therefore will be best understood with reference thereto, where like numerals represent like elements not described again in detail. In the illustrated embodiment, the screen jacket 208 and associated sand screens 214 (FIGS. 2 and 3) have been removed in order to expose a plurality of flow tubes 702 that extend axially from the bulkhead 210. Portions of the bulkhead 210 have also been removed for clarity.

The flow tubes 702 may be similar to the flow tubes 602 of FIGS. 6A and 6B. More particularly, each flow tube 702 may generally exhibit an "H" cross-sectional shape that has a crossbar 604 extending between a pair of legs 606*a* and 606*b* that extend toward the outer surface of the base pipe 202. As depicted, the flow tubes 702 may be circumferentially offset from each other such that a flow channel 704 (two shown) may be defined between angularly adjacent flow tubes 702. Accordingly, each flow channel 704 may be generally defined by the adjacent legs 606*a,b* of the angularly-adjacent flow tubes 702, which generally define the side walls of each flow channel 704, the sand screen 214 (not shown) that extends over the top thereof, and the base pipe 202, which provides a bottom for the flow channels 704. In the illustrated embodiment, several flow tubes 702 have been omitted from the assembly 700, but would otherwise be included about the entire circumference of the base pipe 202.

As illustrated, one or more of the flow tubes 702 may include one or more circumferential perforations 706 defined in one or both of the legs 606*a,b* of a given flow tube 702. In the illustrated embodiment, for example, a series of circumferential perforations 706 are depicted as being defined in the first leg 606*a* of two flow tubes 702. The circumferential perforations 706 may facilitate fluid communication between the interior of the corresponding flow tubes 702 and the angularly adjacent flow channels 704. Accordingly, the circumferential perforations 706 may prove advantageous in allowing the fluid 224 to exit the flow tubes 702 and traverse the sand screen 214 at various axial locations along the axial length of the corresponding flow tubes 702. As a result, the circumferential perforations 710 may help to gradually dissipate the flow energy of the fluid 224 along the flow tubes 702.

In the illustrated embodiment, five (5) circumferential perforations 706 are depicted as being defined in the first leg 606*a* of two flow tubes 702. In other embodiments, as will be appreciated, more or less than five circumferential perforations 706 may be employed. In yet other embodiments, the circumferential perforations 706 may be defined in the second leg 606*b*, or in both the first and second legs 606*a,b*, without departing from the scope of the disclosure. Moreover, the number and density (i.e., frequency) of the circumferential perforations 706 defined in any given flow tube 702 may vary, depending on the application and flow constraints.

Similar to the circumferential perforations 610 of FIG. 6B, the circumferential perforations 706 may be any type or shape of opening in the legs 606*a,b* of the flow tubes 702. For instance, the circumferential perforations 706 may be, but are not limited to, cuts, slots, holes, notches, or any combination thereof defined in the legs 606*a,b* of the flow tubes 702. The size of the circumferential perforations 706 may also vary in order to regulate fluid flow along the axial length of the flow tubes 702. For instance, in some embodiments it may be desirable to have larger circumferential perforations 706 at or near the distal end of the corresponding flow tube 702, which allow a higher volumetric flow rate of the fluid 224 out of the flow tube 702. At the distal end of the flow tube 702, the flow energy of the fluid 224 is more likely to be dissipated and, therefore, less likely to erode the sand screen 214 upon being ejected from the circumferential perforations 706 at high volumetric flow rates.

The proximal end of each flow channel 704 may at least be partially defined by the bulkhead 210 in that no orifice or opening is defined at that location in the bulkhead 210. As a result, fluid flow from the base pipe 202 into the flow channels 704 may be facilitated only through the influx of the fluid 224 via the circumferential perforations 706. In other embodiments, however, those locations on the bulkhead 210 (e.g., the proximal end of each flow channel 704 defined by the bulkhead 210) may include a flow restrictor configured to regulate a flow of the fluid 224 into the flow channels 704 through the bulkhead 210. For instance, a choke, a plug, or an inflow control device may be inserted between flow channels 704 on the bulkhead 210, without departing from the scope of the disclosure.

Moreover, in some embodiments, one or more of the flow tubes 702 may include radial perforations defined therein, similar to the radial perforations 608 of FIG. 6B, without departing from the scope of the disclosure. As a result, the assembly 700 may prove useful in providing the fluid 224 to the flow annulus 216 (FIG. 2) at a plurality of axial and angular locations along the exterior of the base pipe 202 such that the flow of the fluid penetrating the sand screens 214 (FIGS. 2 and 3) may be more evenly distributed.

Again, as mentioned above, while the foregoing embodiments are generally described with reference to injection operations where a fluid 224 (FIG. 2) is injected into a flow annulus 216 (FIG. 2), any of the flow distribution assemblies described herein may equally be used in production operations, without departing from the scope of the disclosure.

Embodiments disclosed herein include:

A. A flow distribution assembly that includes a bulkhead arranged about a base pipe having one or more flow ports defined therein, the bulkhead defining a plurality of flow conduits in fluid communication with the one or more flow ports, at least one sand screen arranged about the base pipe and extending axially from the bulkhead, a flow annulus being defined between the at least one sand screen and the base pipe, and a plurality of flow tubes fluidly coupled to the plurality of flow conduits and extending axially from the bulkhead within the flow annulus, the plurality of flow tubes being configured to place an interior of the base pipe in fluid communication with the flow annulus via the one or more flow ports, wherein the plurality of flow tubes is configured to distribute a fluid through the at least one sand screen at a plurality of axial locations within the flow annulus.

B. A method that includes introducing a flow distribution assembly into a wellbore that penetrates a subterranean formation, the flow distribution assembly being arranged on a base pipe and comprising a bulkhead arranged about the base pipe and defining a plurality of flow conduits in fluid communication with one or more flow ports defined in the base pipe, at least one sand screen arranged about the base pipe and extending axially from the bulkhead, a flow annulus being defined between the at least one sand screen and the base pipe, and a plurality of flow tubes fluidly coupled to the plurality of flow conduits and extending axially from the bulkhead within the flow annulus, pumping a fluid to the flow distribution assembly within an interior of the base pipe, conveying the fluid into the plurality of flow tubes via the one or more flow ports, ejecting the fluid into the flow annulus from the plurality of flow tubes at a plurality of axial locations within the flow annulus, and flowing the fluid through the at least one sand screen and to the subterranean formation at the plurality of axial and angular locations.

C. A method that includes introducing a flow distribution assembly into a wellbore that penetrates a subterranean formation, the flow distribution assembly being arranged on a base pipe and comprising, at least one sand screen arranged about the base pipe and extending axially along an exterior of the base pipe, a flow annulus being defined between the at least one sand screen and the base pipe, and a plurality of flow tubes in fluid communication with one or more flow ports defined in the base pipe and extending axially along the exterior of the base pipe within the flow annulus, flowing a fluid from the subterranean formation through the at least one sand screen and into the flow annulus at a plurality of axial locations along the at least one sand screen, drawing the fluid into the plurality of flow tubes, and conveying the fluid into an interior of the base pipe via the one or more flow ports.

Each of embodiments A, B, and C may have one or more of the following additional elements in any combination: Element 1: further comprising a plurality of ribs extending longitudinally from the bulkhead within the flow annulus and being configured to radially support the at least one sand screen. Element 2: wherein at least one of the plurality of flow tubes is arranged between angularly adjacent ribs of the plurality of ribs. Element 3: wherein the plurality of flow tubes exhibit at least two different axial lengths to thereby distribute the fluid through the at least one sand screen at the plurality of axial locations. Element 4: wherein the plurality of flow tubes are angularly offset from each other about a circumference of the base pipe and thereby distribute the fluid through the at least one sand screen at a plurality of angular locations about the circumference of the base pipe. Element 5: wherein a cross-sectional shape of one or more of the plurality of flow tubes is at least one of circular, polygonal, oval, and kidney-shaped. Element 6: wherein the plurality of flow tubes exhibit at least two inner flow areas that are different from each other. Element 7: further comprising one or more nozzles arranged in a corresponding one or more of the plurality of flow conduits. Element 8: wherein one or more of the plurality of flow tubes is made of an erosion resistant material selected from the group consisting of carbides and ceramics. Element 9: wherein one or more of the plurality of flow tubes is cladded with an erosion resistant material. Element 10: wherein the plurality of flow tubes radially supports the at least one sand screen. Element 11: wherein each flow tube provides first and second legs that contact the base pipe. Element 12: further comprising one or more circumferential perforations defined in one or both of the first and second legs, the one or more circumferential perforations facilitating fluid communication between an interior of a corresponding flow tube and the at least one sand screen. Element 13: further comprising a crossbar that extends between the first and second legs, and one or more radial perforations defined in the crossbar and facilitating fluid communication between an interior of a corresponding flow tube and the at least one sand screen.

Element 14: wherein individual flow tubes of the plurality of flow tubes exhibit at least two inner flow areas, the method further comprising restricting a flow of the fluid through the individual flow tubes having a smaller inner flow area. Element 15: wherein individual flow tubes of the plurality of flow tubes exhibit at least two different axial lengths, and wherein ejecting the fluid into the flow annulus from the plurality of flow tubes further comprises distributing a flow of the fluid through the at least one sand screen at the at least two different axial lengths. Element 16: further comprising radially supporting the at least one sand screen with the plurality of flow tubes. Element 17: wherein at least one of the plurality of flow tubes provides first and second legs that contact the base pipe and one or more circumferential perforations are defined in one or both of the first and second legs, and wherein ejecting the fluid into the flow annulus from the plurality of flow tubes further comprises flowing the fluid through the one or more circumferential perforations from an interior of the at least one of the plurality of flow tubes. Element 18: wherein at least one of the plurality of flow tubes provides first and second legs, a crossbar extending between the first and second legs, and one or more radial perforations defined in the crossbar, and wherein ejecting the fluid into the flow annulus from the plurality of flow tubes further comprises flowing the fluid through the one or more radial perforations from an interior of the at least one of the plurality of flow tubes. Element 19: further comprising radially supporting the at least one sand screen with a plurality of ribs extending longitudinally from the bulkhead within the flow annulus. Element 20: wherein the plurality of flow tubes are angularly offset from each other about a circumference of the base pipe, the method further comprising ejecting the fluid into the flow annulus from the plurality of flow tubes at a plurality of angular locations about the circumference of the base pipe, and flowing the fluid through the at least one sand screen and to the subterranean formation at the plurality of angular locations.

Element 21: wherein the plurality of flow tubes are angularly offset from each other about a circumference of the base pipe, the method further comprising flowing the fluid through the at least one sand screen and into the flow annulus at a plurality of angular locations about the circumference of the base pipe. Element 22: wherein the flow distribution assembly further includes a bulkhead arranged about the base pipe and defining a plurality of flow conduits in fluid communication with the one or more flow ports, the plurality of flow tubes being fluidly coupled to the plurality of flow conduits and extending axially from the bulkhead, and wherein conveying the fluid into the interior of the base pipe via the one or more flow ports further comprises conveying the fluid through the plurality of flow tubes to the bulkhead.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A flow distribution assembly, comprising:

a bulkhead arranged about a base pipe having one or more flow ports defined therein, the bulkhead defining a plurality of flow conduits in fluid communication with the one or more flow ports;

at least one sand screen arranged about the base pipe and extending axially from the bulkhead, a flow annulus being defined between the at least one sand screen and the base pipe; and a plurality of flow tubes fluidly coupled to the plurality of flow conduits and extending axially from the bulkhead within the flow annulus, the plurality of flow tubes being configured to place an interior of the base pipe in fluid communication with the flow annulus via the one or more flow ports, wherein the plurality of flow tubes exhibit at least two different axial lengths extending within the flow annulus beneath the at least one sand screen to distribute a fluid through the at least one sand screen at a plurality of axial locations within the flow annulus.

2. The flow distribution assembly of claim 1, further comprising a plurality of ribs extending longitudinally from the bulkhead within the flow annulus and being configured to radially support the at least one sand screen.

3. The flow distribution assembly of claim 2, wherein at least one of the plurality of flow tubes is arranged between angularly adjacent ribs of the plurality of ribs.

4. The flow distribution assembly of claim 1, wherein the plurality of flow tubes are angularly offset from each other about a circumference of the base pipe and thereby distribute the fluid through the at least one sand screen at a plurality of angular locations about the circumference of the base pipe.

5. The flow distribution assembly of claim 1, wherein a cross-sectional shape of one or more of the plurality of flow tubes is circular, polygonal, oval, or kidney-shaped.

6. The flow distribution assembly of claim 1, wherein the plurality of flow tubes exhibit at least two inner flow areas that are different from each other.

7. The flow distribution assembly of claim 1, further comprising one or more nozzles arranged in a corresponding one or more of the plurality of flow conduits.

8. The flow distribution assembly of claim 1, wherein one or more of the plurality of flow tubes is made of an erosion resistant material selected from the group consisting of a carbide, a ceramic, and any combination thereof.

9. The flow distribution assembly of claim 1, wherein one or more of the plurality of flow tubes is cladded with an erosion resistant material.

10. The flow distribution assembly of claim 1, wherein the plurality of flow tubes radially supports the at least one sand screen.

11. The flow distribution assembly of claim 10, wherein each flow tube provides first and second legs that contact the base pipe.

12. The flow distribution assembly of claim 11, further comprising one or more circumferential perforations defined in one or both of the first and second legs, the one or more circumferential perforations facilitating fluid communication between an interior of a corresponding flow tube and the at least one sand screen.

13. The flow distribution assembly of claim 11, further comprising:

a crossbar that extends between the first and second legs; and one or more radial perforations defined in the crossbar and facilitating fluid communication between an interior of a corresponding flow tube and the at least one sand screen.

14. A method, comprising:

introducing a flow distribution assembly into a wellbore that penetrates a subterranean formation, the flow distribution assembly being arranged on a base pipe and comprising:

a bulkhead arranged about the base pipe and defining a plurality of flow conduits in fluid communication with one or more flow ports defined in the base pipe;

at least one sand screen arranged about the base pipe and extending axially from the bulkhead, a flow annulus being defined between the at least one sand screen and the base pipe; and a plurality of flow tubes fluidly coupled to the plurality of flow conduits and extending axially from the bulkhead within the flow annulus;

conveying a fluid to the flow distribution assembly and into the plurality of flow tubes via the one or more flow ports;

injecting the fluid into the flow annulus from the plurality of flow tubes at a plurality of axial locations within the flow annulus; and flowing the fluid through the at least one sand screen and to the subterranean formation at the plurality of axial and angular locations.

15. The method of claim 14, wherein individual flow tubes of the plurality of flow tubes exhibit at least two inner flow areas, the method further comprising restricting a flow of the fluid through the individual flow tubes having a smaller inner flow area.

16. The method of claim 14, wherein individual flow tubes of the plurality of flow tubes exhibit at least two different axial lengths, and wherein ejecting the fluid into the flow annulus from the plurality of flow tubes further comprises distributing a flow of the fluid through the at least one sand screen at the at least two different axial lengths.

17. The method of claim 14, further comprising radially supporting the at least one sand screen with the plurality of flow tubes.

18. The method of claim 17, wherein at least one of the plurality of flow tubes provides first and second legs that contact the base pipe and one or more circumferential perforations are defined in one or both of the first and second legs, and wherein ejecting the fluid into the flow annulus from the plurality of flow tubes further comprises flowing the fluid through the one or more circumferential perforations from an interior of the at least one of the plurality of flow tubes.

19. The method of claim 17, wherein at least one of the plurality of flow tubes provides first and second legs, a crossbar extending between the first and second legs, and one or more radial perforations defined in the crossbar, and wherein ejecting the fluid into the flow annulus from the plurality of flow tubes further comprises flowing the fluid through the one or more radial perforations from an interior of the at least one of the plurality of flow tubes.

20. The method of claim 14, further comprising radially supporting the at least one sand screen with a plurality of ribs extending longitudinally from the bulkhead within the flow annulus.

21. The method of claim 14, wherein the plurality of flow tubes are angularly offset from each other about a circumference of the base pipe, the method further comprising:

ejecting the fluid into the flow annulus from the plurality of flow tubes at a plurality of angular locations about the circumference of the base pipe; and flowing the fluid through the at least one sand screen and to the subterranean formation at the plurality of angular locations.

22. A method, comprising:

introducing a flow distribution assembly into a wellbore that penetrates a subterranean formation, the flow distribution assembly being arranged on a base pipe and comprising:

at least one sand screen arranged about the base pipe and extending axially along an exterior of the base pipe, a flow annulus being defined between the at least one sand screen and the base pipe; and a plurality of flow tubes in fluid communication with one or more flow ports defined in the base pipe and extending axially along the exterior of the base pipe within the flow annulus, wherein the plurality of flow tubes exhibit at least two different axial lengths extending within the flow annulus beneath the at least one sand screen;

flowing a fluid from the subterranean formation through the at least one sand screen and into the flow annulus;

drawing the fluid into the plurality of flow tubes within the flow annulus at a plurality of axial locations along the at least one sand screen; and conveying the fluid into an interior of the base pipe via the one or more flow ports.

23. The method of claim 22, wherein the plurality of flow tubes are angularly offset from each other about a circumference of the base pipe, the method further comprising flowing the fluid through the at least one sand screen and into the flow annulus at a plurality of angular locations about the circumference of the base pipe.

24. The method of claim 22, wherein the flow distribution assembly further includes a bulkhead arranged about the base pipe and defining a plurality of flow conduits in fluid communication with the one or more flow ports, the plurality of flow tubes being fluidly coupled to the plurality of flow conduits and extending axially from the bulkhead, and wherein conveying the fluid into the interior of the base pipe via the one or more flow ports further comprises conveying the fluid through the plurality of flow tubes to the bulkhead.

* * * * *